US006606865B2

(12) United States Patent
Tilson et al.

(10) Patent No.: US 6,606,865 B2
(45) Date of Patent: Aug. 19, 2003

(54) BELLOWS TYPE OUTER CROSSFIRE TUBE

(75) Inventors: Keith Tilson, Nottingham (GB); Harmon Lindsay Morton, Simpsonville, SC (US); Richard Anthony Elliott, Acworth, GA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/984,872

(22) Filed: Oct. 31, 2001

(65) Prior Publication Data

US 2003/0079462 A1 May 1, 2003

(51) Int. Cl.[7] ..... F02C 7/26; F23R 3/48

(52) U.S. Cl. ..... 60/800; 60/39.37

(58) Field of Search ..... 60/39.37, 746, 60/747, 798, 800; 285/226, 299, 300, 301

(56) References Cited

U.S. PATENT DOCUMENTS

| | | | | | |
|---|---|---|---|---|---|
| 856,839 | A | | 6/1907 | Bickel | |
| 1,049,542 | A | | 1/1913 | Smith | |
| 1,095,100 | A | | 4/1914 | Fulton | |
| 2,099,984 | A | | 11/1937 | Lundquist | |
| 2,209,239 | A | | 7/1940 | Sterzenbach | |
| 2,358,291 | A | | 9/1944 | Fentress | |
| 2,406,234 | A | * | 8/1946 | Marancik et al. | 285/299 |
| 2,437,385 | A | | 3/1948 | Halford | |
| 2,679,136 | A | * | 5/1954 | Gaubatz | 60/800 |
| 2,722,803 | A | * | 11/1955 | Travers | 60/39.37 |
| 2,729,938 | A | | 1/1956 | McDowall et al. | |
| 2,818,704 | A | * | 1/1958 | Karcher | 60/39.7 |
| 2,832,195 | A | | 4/1958 | Weissborn, Jr. | |
| 2,839,894 | A | * | 6/1958 | Shutts et al. | 60/39.37 |
| 2,927,625 | A | | 3/1960 | Rothermel et al. | |
| 3,001,366 | A | * | 9/1961 | Shutts | 60/39.37 |
| 3,129,777 | A | | 4/1964 | Haspert | |
| 3,344,601 | A | | 10/1967 | Mieczkowski, Jr. | |
| 3,431,948 | A | | 3/1969 | Goldenberg | |
| 3,492,030 | A | * | 1/1970 | Harrison et al. | 285/300 |
| 3,991,560 | A | | 11/1976 | DeCorso et al. | |
| 4,091,063 | A | | 5/1978 | Logan | |
| 4,249,372 | A | | 2/1981 | White | |
| 4,610,468 | A | | 9/1986 | Wood | |
| 4,819,970 | A | | 4/1989 | Umehara | |
| 4,858,897 | A | | 8/1989 | Irifune | |
| 5,082,315 | A | | 1/1992 | Sauer | |
| 5,125,694 | A | | 6/1992 | Gobbi | |
| 5,286,071 | A | * | 2/1994 | Storage | 285/226 |
| 5,361,577 | A | | 11/1994 | Cromer | |
| 5,407,237 | A | * | 4/1995 | Smolowitz | 285/226 |

FOREIGN PATENT DOCUMENTS

| | | | |
|---|---|---|---|
| EP | 0040268 | * | 5/1980 |

* cited by examiner

*Primary Examiner*—Ted Kim
(74) *Attorney, Agent, or Firm*—Nixon & Vanderhye P.C.

(57) ABSTRACT

An outer crossfire tube for attachment between adjacent combustors in a land-based gas turbine includes a substantially cylindrical bellows portion and a pair of uniform diameter free ends on opposite sides of the bellows portion, the uniform diameter free ends adapted to seat within apertures provided in the adjacent combustors. The outer crossfire tube is surrounded by a telescoping sleeve assembly, with remote ends of a pair of telescoping sleeve members fixed to respective combustor flanges.

11 Claims, 1 Drawing Sheet

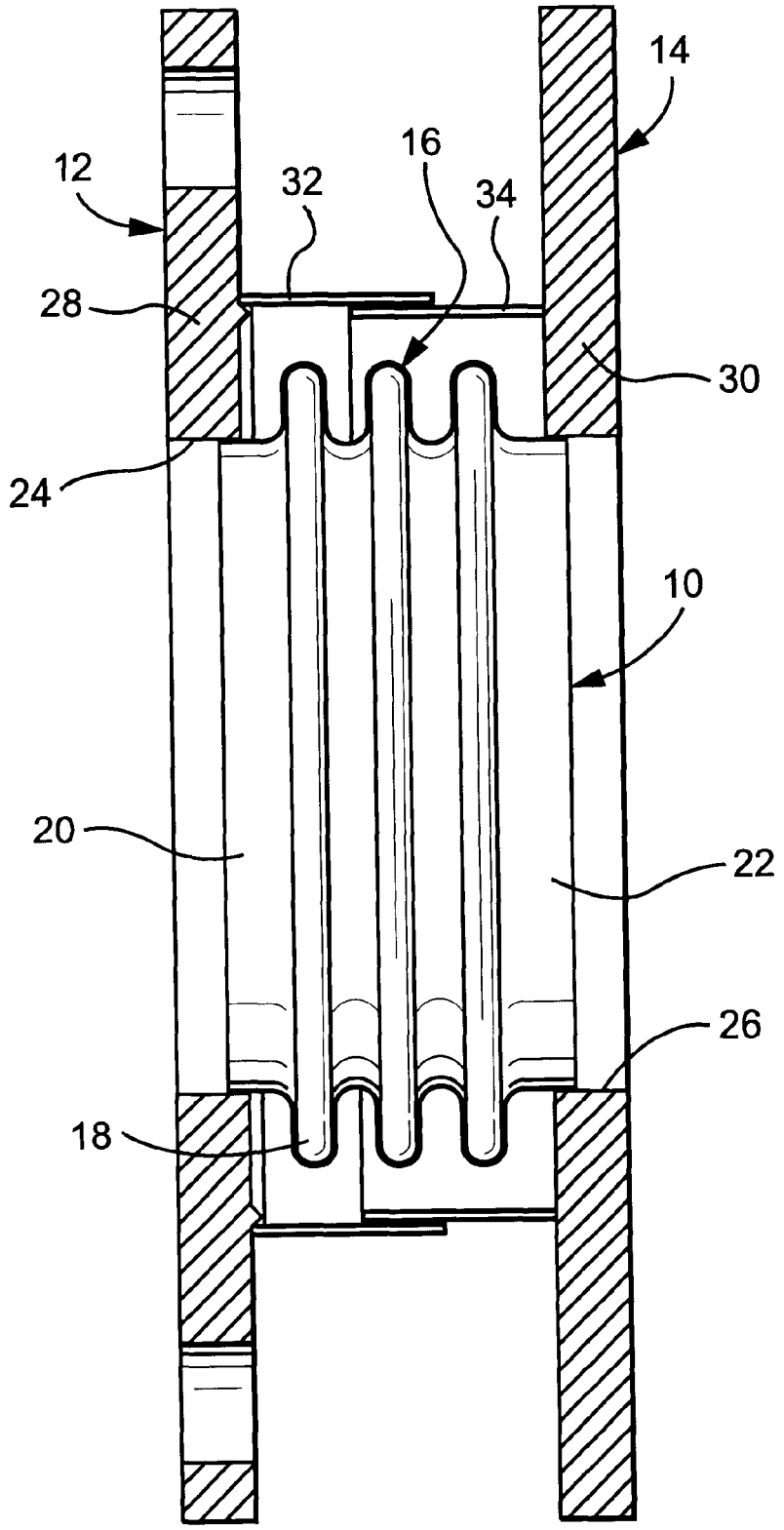
14
16
12
32
34
28
30
24
10
20
22
26
18

BELLOWS TYPE OUTER CROSSFIRE TUBE

BACKGROUND OF THE INVENTION

This invention relates to crossfire tubes extending between adjacent combustors in a land-based gas turbine.

The annular arrangement of combustors in a stationary, or land-based gas turbine with interconnecting crossfire tubes is generally well known as disclosed in, for example, commonly owned U.S. Pat. No. 4,249,372. The '372 patent describes a typical cross ignition assembly that includes tubular members extending between aligned openings in adjacent combustors, and held in place by means that position the opposite ends of the tubular members or crossfire tubes in fluid communication with the adjacent combustion chambers. The purpose of the crossfire tubes is to provide for the ignition of fuel in one combustion chamber from ignited fuel in an adjacent combustion chamber, thereby eliminating the need for a separate igniter in each combustor. Specifically, chamber to chamber crossfire is accomplished by a pressure pulse of hot gases transferring from a firing chamber to an unfired chamber through the crossfire tube. The crossfire tubes also serve the purpose of equalizing to some extent the pressures between combustion chambers.

Concerns have existed with respect to increased temperatures and pressures in modern turbomachinery resulting in instances of leakage and/or blowout with existing crossfire tube designs. Various crossfire tube configurations have been utilized. For example, convoluted bellows type crossfire tubes have been tried, and are described in commonly owned U.S. Pat. No. 5,361,577. A flexible crossfire tube construction is described in U.S. Pat. No. 3,991,560. These designs may be considered overly complex however, increasing cost and installation time.

BRIEF DESCRIPTION OF THE INVENTION

This invention relates to a bellows type outer crossfire tube that is of simplified design and construction. The outer crossfire tube houses an inner crossfire tube that transmits the hot gas pressure pulse during crossfire. The inner crossfire tube is unchanged and is thus not a part of the invention. The bellows configuration for the outer tube is designed to provide a reduction in part count and thus a reduction in installation/removal and associated field service costs. In the preferred arrangement, the outer crossfire tube is generally cylindrical in shape and includes a bellows portion and a pair of uniform diameter free ends on opposite sides of the bellows portion. The free ends are adapted to seat, under compression, within respective apertures provided in adjacent combustor flanges. The design is particularly useful as a retrofit component for existing turbines, with an analytical design life of 2400 cycles and 48,000 hours. The design accommodates lateral and axial deflections due to tolerance stack-ups and expansions, and the construction materials are selected to meet operating specifications.

The outer crossfire tube is preferably utilized in combination with an outer sleeve assembly that surrounds the outer crossfire tube and is made up of a pair of telescoping sleeve members, each welded to a respective one of the combustor flanges.

Accordingly, in one aspect, the invention relates to a crossfire tube for attachment between adjacent combustors in a land-based gas turbine consisting of a substantially cylindrical bellows portion and a pair of uniform diameter free ends on opposite sides of the bellows portion, the uniform diameter free ends adapted to seat within apertures provided in the adjacent combustors.

In another aspect, the invention relates to a crossfire tube for attachment between adjacent combustors consisting of a substantially cylindrical bellows portion and a pair of uniform diameter free ends on opposite sides of the bellows portion, the uniform diameter free ends adapted to seat within apertures provided in the adjacent combustors; wherein diameters of the substantially uniform diameter free ends are substantially identical to a minimum diameter of the bellows portion; and further wherein the crossfire tube is constructed of a Nickel alloy and capable of withstanding temperatures up to 784° F. and internal pressures up to 248 psi.

In still another embodiment, the invention relates to a combustor and crossfire tube assembly comprising at least a pair of adjacent combustors each provided with a flange formed with an aperture therein and a crossfire tube extending between the apertures, the crossfire tube consisting of a bellows portion and uniform diameter free ends on opposite sides of the bellows portion, the free ends received in the apertures.

The crossfire tube and related assembly in accordance with the invention will now be described in conjunction with the single drawing figure.

BRIEF DESCRIPTION OF THE DRAWINGS

The single drawing FIGURE is a side elevation partly in section, of an outer crossfire tube in accordance with one exemplary embodiment of the invention.

DETAILED DESCRIPTION OF THE INVENTION

With reference to the drawing, an outer crossfire tube 10 is shown, in place, between a pair of adjacent combustors 12 and 14. As noted above, the inner crossfire tube is not part of this invention and is thus not shown in the drawing. The outer crossfire tube 10 is generally cylindrical in shape and includes a bellows portion 16 that extends the majority of the axial or length dimension of the tube. The bellows portion is of typical bellows construction with inner and outer diameters as defined by the axially spaced convolutions 18. A pair of uniform diameter (internal and external) free ends 20, 22 are located on opposite sides of the bellows portion. The respective diameters of these free ends are substantially identical to the inner diameter of the bellows portion 16.

The free ends 20, 22 are adapted to fit within a pair of correspondingly shaped apertures 24, 26, respectively, formed in flanges 28, 30 of the adjacent combustors 12, 14. Flanges 28, 30 are preferably Chromium Molybdenum alloys, with six bolt holes per flange, the latter utilized to secure the flanges to the combustors.

The crossfire tube, and specifically the bellows portion 16, is under compression when located in the apertures 22, 24, thus ensuring that it will remain in place during operation. The number of ripples or convolutions in the bellows portion 16 is application specific. Critical design parameters for the tube 10 include sufficient strength to sustain the pressure load across the tube, and a natural frequency that differs from that of the combustors so that the crossfire tube will not vibrate in synch with the combustors 12, 14. In the preferred embodiment, the crossfire tube 10 is constructed of a suitable Ni Alloy, although other suitable alloys may be employed. The preferred embodiment is designed to withstand internal pressures and temperatures throughout the operating or working range up to about 784° F. and 248 psi.

A pair of telescoping sleeve members 32, 34 are welded to respective combustor flanges 28, 30 and are thus able to move or vibrate axially relative to each other. The sleeve members 32, 34 surround and protect the outer crossfire tube 10 and have length dimensions determined by combustor spacing. The preferred material for the sleeves is 321 Stainless Steel.

The above described outer crossfire tube is a simple yet reliable design, eliminating previously required parts, reducing costs and installation time. It is particularly advantageous as a retrofit to existing combustors.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A crossfire tube for attachment between adjacent combustors in a land-based gas turbine comprising a substantially cylindrical bellows portion and a pair of uniform external diameter free ends on opposite sides of said bellows portion, said uniform external diameter free ends adapted to seat within apertures provided in the adjacent combustors; and a pair of telescoping sleeve members adapted to surround the crossfire tube, respective ones of said pair of telescoping sleeve members adapted for securement to the adjacent combustors.

2. The crossfire tube of claim 1 constructed of a Nickel alloy and capable of withstanding temperatures up to 784° F. and internal pressures up to 248 psi.

3. The crossfire tube of claim 1 wherein diameters of said substantially uniform diameter free ends are substantially identical to an inner diameter of said bellows portion.

4. The crossfire tube of claim 1 wherein said sleeve members are constructed of stainless steel.

5. An outer crossfire tube for attachment between adjacent combustors consisting of a substantially cylindrical bellows portion and a pair of uniform external diameter free ends on opposite sides of said bellows portion, said uniform external diameter free ends adapted to seat within apertures provided in the adjacent combustors; wherein diameters of said substantially uniform external diameter free ends are substantially identical to a minimum diameter of said bellows portion; and further wherein said crossfire tube is constructed of a Nickel alloy and capable of withstanding temperatures up to 784° F. and internal pressures up to 248 psi.

6. A combustor and crossfire tube assembly comprising at least a pair of adjacent combustors each provided with a flange formed with an aperture therein and an outer crossfire tube extending between the apertures, said outer crossfire tube consisting of a bellows portion and uniform external diameter free ends on opposite sides of said bellows portion, said free ends received in said apertures.

7. The assembly of claim 6 wherein the outer crossfire tube is constructed of a Nickel alloy capable of withstanding temperatures up to 784° F. and internal pressures up to 248 psi.

8. The assembly of claim 6 wherein diameters of said substantially uniform diameter free ends are substantially identical to a minimum diameter of said bellows portion.

9. The assembly of claim 6 wherein said flanges are constructed of a Chromium Molybdenum alloy.

10. A combustor and crossfire tube assembly comprising at least a pair of adjacent combustors each provided with a flange formed with an aperture therein and an outer crossfire tube extending between the apertures, said outer crossfire tube consisting of a bellows portion and uniform external diameter free ends on opposite sides of said bellows portion, said free ends received in said apertures; wherein a telescoping sleeve assembly surrounds the outer crossfire tube, said sleeve assembly comprising a pair of sleeve members fixed at respective ends to said combustor flanges.

11. The assembly of claim 10 wherein said sleeve members are constructed of stainless steel.

* * * * *